US005833240A

United States Patent [19]

Barbour

[11] Patent Number: 5,833,240

[45] Date of Patent: Nov. 10, 1998

[54] DEXTERITY GAME BOARD APPARATUS

[76] Inventor: William P. Barbour, 116 Woodley Rd., Moneta, Va. 24121

[21] Appl. No.: 953,116

[22] Filed: Oct. 17, 1997

[51] Int. Cl.[6] ..... A63F 3/02

[52] U.S. Cl. ..... 273/282.1

[58] Field of Search ..... 273/260, 261, 273/282.1, 287, 281

[56] References Cited

U.S. PATENT DOCUMENTS

| | | | |
|---|---|---|---|
| 818,582 | 4/1906 | Thomas | 273/282.1 |
| 1,343,984 | 6/1920 | Ramsey | 273/282.1 |
| 1,700,016 | 1/1929 | Belanger | 273/281 X |
| 2,215,936 | 9/1940 | Robertson | 273/282.1 X |
| 3,031,193 | 4/1962 | Chapman | 273/282.1 X |
| 3,588,112 | 6/1971 | Holt | 273/282.1 |
| 4,603,863 | 8/1986 | Meyer | 273/282.1 |
| 5,314,191 | 5/1994 | Mayas | 273/282.1 X |

*Primary Examiner*—William E. Stoll
*Attorney, Agent, or Firm*—Steven Lin

[57] ABSTRACT

A game board for providing entertainment has playing areas in the form of recesses 14 that receive uniquely formed tokens or playing pieces 20. The recesses may have an upwardly facing flat surface 16 located below the board upper surface 12 at a depth that allows the token upper surface 24 to be flush with the game board upper surface 12. For removal from a recess 14, the token 20 is tilted by finger pressure on the peripheral edge of the token followed by grasping. After being moved to an appropriate adjacent recess, the token is dropped in a recess whereby the token assumes a position where its upper surface is flush with the game board upper surface 12. An electronic timer 40 and switch 38 are provided to limit the time allowed for making the physical moves with the tokens, thereby testing the dexterity of the players.

14 Claims, 1 Drawing Sheet

DEXTERITY GAME BOARD APPARATUS

This invention relates to a game board having tokens that are uniquely shaped for playing various games. The game board has a flat playing surface having a pattern of playing areas defined by recesses of equal size that are arranged in rows and columns and is used in combination with tokens or playing pieces and optionally an attached timer.

BACKGROUND

Games such as chess, checkers, Chinese checkers, backgammon and the like involving a playing board and movable playing pieces have been around since ancient times. The playing surface is usually smooth or sometimes formed to restrain movement of the tokens or playing pieces for reasons unrelated to the playing of the game.

Many games require concentration, strategic planning and a random number generator such as the rolling of dice or the spinning of an arrow. Most games are played at a leisurely pace, a condition that in the past was agreeable to many people. But times change and people of the present generation are attuned to faster action and more vigorous competition.

SUMMARY OF INVENTION

An object of the present invention is to provide a novel playing board and a unique playing piece or token construction which are adapted for use together in playing games requiring a combination of skills.

In a preferred embodiment, speed of movement and digital dexterity become important factors in determining the winner. The need for dexterity derives from the fact that the playing pieces or tokens each set in recesses in the playing board such that the token is impossible to grasp unless it is first tipped up by means of finger pressure acting against the token in a prescribed manner. The need for speed arises when each player's move must be completed in a very short time interval controlled by a pre-set timer. The combination of skills required to play this game results in a degree of activity and spontaneous hilarity not present in other board games of which I am aware.

The spacing of the recesses in the playing board is such that the playing areas lie along parallel lines running in diagonal directions. In an illustrative embodiment, the board may have at least eight rows and eight columns of playing areas with alternate rows and columns being offset. The spacing is such that the playing areas lie along parallel lines running in a diagonal direction. This provides an active field on the board with 32 playing areas. Other playing area patterns may be used if desired.

Each player has a unique set of tokens, sometimes referred to as playing pieces, as in other games using game boards. A different color for each set may be used and the exterior surfaces polished to provide a slippery feel. Each player starts with the same number of tokens that are located at corresponding positions on the game board. Twelve tokens from each token set may be distributed as is illustrated in FIG. 1. Two rows of four playing areas on opposite sides of the longest diagonal line may be left empty to serve as a receiving area for a token that is being moved.

The object of a representative game is to be the first to remove all of your own tokens from the game board. A token can be removed by jumping your own man following the protocol of movement used in the familiar checkers game. Tokens may be moved forward or backwards, but only along a diagonal. A player's own token can be removed only if the token is jumped. You may jump an opponents token, but you cannot remove it. One way to terminate a game is when only one token remains on the board.

Several variations of the basic game described above are possible. One variation involves the use of a timer 40 which forces the player to complete his play in a limited period of time. Once a player has selected the token that he wishes to move, the interval may be as short as a second or two. The timer 40 is set to an interval previously agreed upon. A start button 38 which may be attached to, or made a part of, the game board 10, is tapped by the person when he is ready to make a play and the play period of not more than about a few seconds is provided for making each move. In the event a player fails to complete a move within the prescribed time limit, he must leave his token in the playing area aimed for and add a penalty token in the playing area from which the move originated.

A penalty token may have a painted symbol such as a star. Penalty tokens may be moved to take regular tokens of like color, but must remain on the board until the end of the game.

Another variation involves the use of a novel board surface that is modified so that each playing area is formed as a recess. The size and shape of the token become important. The thickness of each token is equal to the depth of the recess so that the token upper surface is flat and flush with the upper surface of the board. The token is preferably constructed so that when the token is dropped into a recess, the upper surface is not left in a tilted position in which case it would be easier to remove. As will become apparent from the claims and from the description as it proceeds in conjunction with the appended drawings, the dexterity of a player's hands has an impact on the outcome of the game.

DETAILED DESCRIPTION

Figure 2:
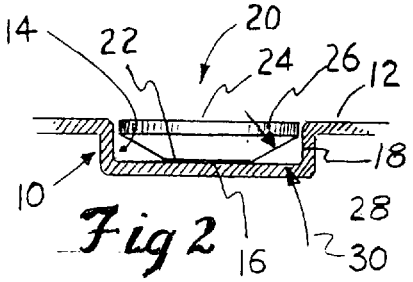
FIG. 2 is a partial view in section of the game board taken along lines 2—2 showing a token properly positioned in one of the recesses in the upper surface of the game board.

With reference to the drawings, a game board 10 has a flat upper surface 12 with a plurality of circular recesses 14 that serve as playing areas. The recesses 14 are provided in a pattern that resembles the pattern of the square playing areas of a typical checker board with the recesses being aligned in horizontal rows and vertical columns so as to provide parallel lines of recesses 14 that are uniformly spaced. The board 10 may be made of any rigid material including heavy cardboard or wood or other material which may be compressed by a punch that forms a generally hemispherical recess. Alternatively, a hole may be formed and an insert installed. It is preferred to use a thermoplastic material in which the recesses 14 can be vacuum formed. It is important that all thirty two of the recesses 14 are identical in size and shape. The recess 14 may advantageously have a flat lower surface 16 that is parallel to the upper surface 12 with a cylindrically shaped connecting wall 18 as illustrated in FIG. 2.

Figure 3:
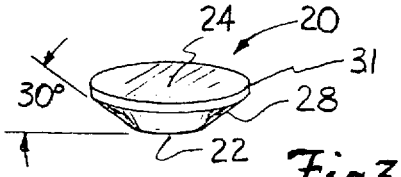
FIG. 3 is a pictorial view of a token shown in FIG. 2.

Each player is provided with a predetermined number of tokens or playing pieces 20, one of which is shown in FIG. 3. The tokens 20 are shown in a normal playing position in a recess 14 in FIGS. 1 and 2 for starting a game. Each token 20 has a flat upper surface and has a generally hemispherical or dish shape, depending upon the specific shape of the recess 14 in the game board 10. In a preferred embodiment, token 20 may have a lower flat surface 22 which rests on flat surface 16 in the recess of the game board 10. When properly positioned, the upper peripheral surface 24 of the token 20 is flush with the upper surface 12 of the game board 10. This flush relationship is important to the playing of some of the games according to the present invention. The token upper surface 24 may be planar or slightly dished in its center.

Figure 4A:
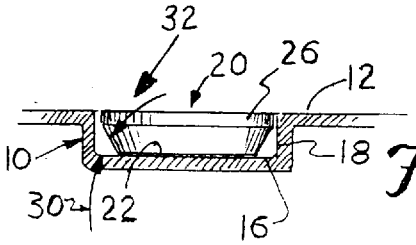
FIGS. 4A and 4B are views of tokens having bases which are too large or too small, respectively, for optimal cooperation with a recess of the type shown in FIG. 2.
Figure 4B:
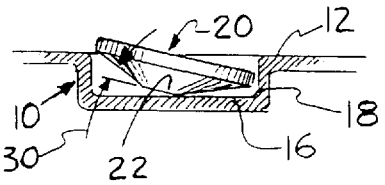

The diameter of the upper surface 24 of token 20 is preferably about 28.6 mm. The diameter of the lower surface 22 is about one half the size of the upper diameter. The connecting side wall 26 may have a lower portion 28 having the shape of a truncated cone. The angle between the lower flat surface 22 (if extended) and an element along the sloping surface of the lower portion 28 is important. If the angle 30 is too large as illustrated in FIG. 4A, the token 20 is too difficult to tilt by the force applied to the token along the direction of arrow 32 and grasp between a finger and a thumb. If the angle 30 is too small as illustrated in FIG. 4B, the token, upon release, will not reliably assume its proper position with the periphery of the upper surface 24 being flush with that part of the upper surface 12 of the game board 10 that surrounds a recess 18. For a token as described having a thickness of about 6.36 mm., the preferred angle 30 is about 30 degrees. This configuration leaves a wall portion 31 having a cylindrical shape under the peripheral edge of the upper surface 24 of token 20.

Figure 1:
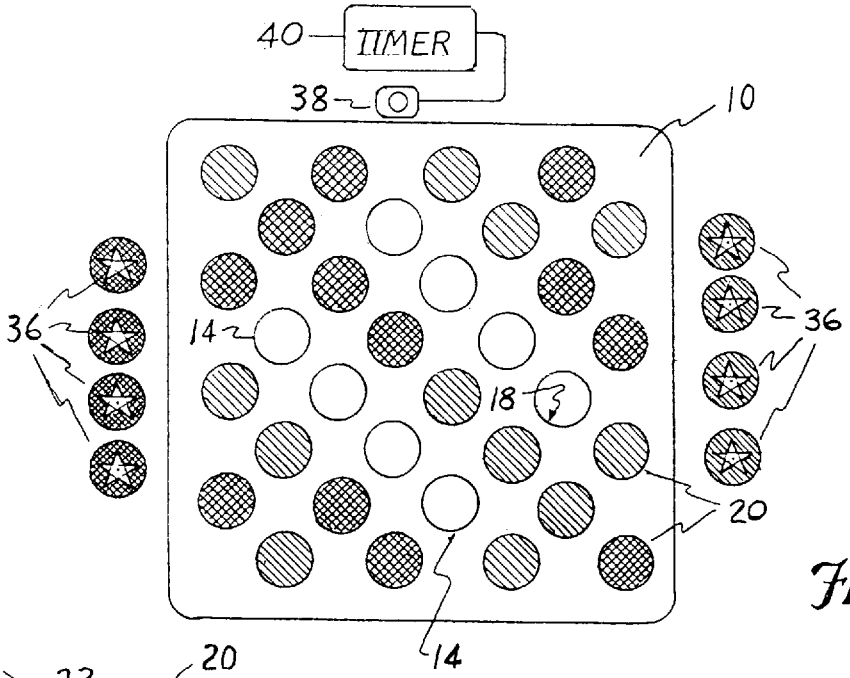
FIG. 1 is a plan view of a game board illustrating the present invention.

The token 20 is preferably made out of any material that is rigid, smooth and slippery to the grasp. Two different colors are indicated by the different cross hatching used in FIGS. 1 and 5. The circles 14 in FIG. 1 represent recesses 14 in the game board that do not have tokens when the game starts according the rules of one possible game.

The diameter of the cylindrical wall 18 for the recess 14 must be slightly larger than the diameter of the periphery of the token upper surface 24 to provide a clearance so that essentially friction free sliding movement is provided when a player seeks to remove a token 20 from its recess 14. To prevent a person having a long fingernail from gaining an advantage when seeking to remove a token 20 from a recess 14, this clearance should be smaller than the thickness of a long fingernail and may be on the order of 0.46 mm.

The ability of each token 20 to tilt must be uniform. The diameter of the recess in the board surface should be just sufficient to allow tipping of the token, and not be so large as to allow a sideways sliding movement of the token in the recess. To make the tokens or playing pieces slippery to the grasp which is an important feature of some games played with the game board and tokens described above, the tokens should be solid and symmetrical, and all surfaces are preferably highly polished.

A second class of token my be provided which has a unique mark such as a star on the upper surface 24 of such token. Each player may have four such star marked tokens 36 for use as illustrated in FIG. 1. The uniquely marked pieces can capture other pieces of like color but must remain on the board until the end of the game. The game ends when only star pieces remain—or when only one non-star piece remains on the board.

Rules of a typical game are as follows:

1. The board 10 may be set up with a pattern of tokens as illustrated in FIG. 1. Each player is shown to have twelve tokens 20 on a board 10 having thirty two recesses 14.

2. Each player has an additional four unique tokens 36 of the same color as his original tokens which have a star as a unique designator.

3. A timer 40 is set to a time interval, such as one or two seconds after the decision is made as to what the move will be. The time interval starts when a player actuates timer 40 as by touching a switching element 38 as his hand is on its way to the token that he intends to move. When the interval has expired, an audible signal is generated by the timer 40. The succeeding time interval does not commence until the player has decided what his next move will be. In its simplest form, the time interval may remain constant for any particular game.

Figure 5:
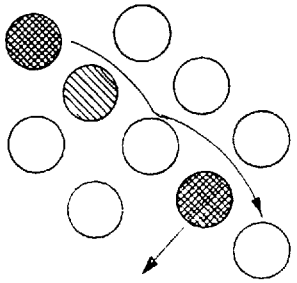
FIG. 5 illustrates an allowable move according to the rules of one game described as an illustrative embodiment.

4. The object of the game is to be first to remove your own tokens off the board by jumping them as in checkers. The first player takes as many of his own tokens as he can off the board by jumping them with diagonal moves, forward or backward, as illustrated in FIG. 5. The opponent's token may be jumped, but cannot be removed. A non-jump move is limited to movement to an adjacent unoccupied recess along a diagonal as in checkers.

5. In the event a player fails to complete a move within the set time interval, he must leave his token in the pocket or recess 14 aimed for and as a penalty he must place a unique token 36, i.e. star piece, in the pocket or recess from which the move originated.

6. Star pieces can take other pieces of like color off the board, but must remain on the board until the end of the game.

7. Any token 20 falling upside down into a recess must remain there until the game ends.

8. The game ends when only star pieces remain or if no star pieces are on the board when only one token remains.

9. Removal of a token is scored as a plus one.

10. An unremoved token is a minus one; however, if it is the last and sole token of the winning player on the board, it becomes a plus one.

11. Each star piece remaining on the board is a minus two.

12. Collect score after each match; first player to reach 50 wins.

Many variations of the described game are possible using a game board and tokens described herein. All modifications and variations falling within the scope of the appended claims are intended to be covered thereby. While use of the timer 40 is not essential for many games, its presence adds to the excitement and intensity of interest for people of different ages. With short time intervals, the player's dexterity frequently determines the winner.

What is claimed is:

1. In combination:

a. a game board having a plurality of circular recesses in an upper flat board surface that have substantially the same depth and the same peripheral size and shape, said recesses being aligned in rows and columns to define a playing area and being uniformly spaced to provide parallel lines of recesses along diagonal directions in said playing field;

b. a first group of tokens that are adapted for use by a first player, a second group of tokens that are distinguishable from said first group and adapted for use by a second player, all of said tokens in both groups being made of a rigid slippery material having a generally hemispherical shape and sized to fit into the upper board recesses, c. each of said tokens having a flat upper surface that lies flush with that portion of the flat board surface which surrounds a recess when one of said tokens is positioned in one of said recesses in the playing area; and d. each of said tokens having a lower surface that fits in a respective one of said recesses in a manner that allows lifting of a token from its respective recess by tilting of the token in response to a downwardly directed force by a finger of a player.

2. The combination as defined in claim 1 wherein the differences in the size of the diameters of the recess and the token are such as to prevent a long fingernail from entering the space between the peripheral edge of the token and a facing inner surface of the recess when the token is resting in the recess with the upper surface of the token being flush with the upper surface of the board.

3. The combination as defined in claim 2 further including a timer for producing an audible signal at the end of a preselected time interval which is commenced by movement of a hand as said hand proceeds toward a particular token.

4. The combination as defined in claim 3 wherein the number of recesses defining the playing area is thirty two and twelve tokens for each player are positioned on the game board in a pattern.

5. The combination as defined in claim 3 wherein each recess has a lower flat surface that is parallel to the upper board flat surface and each token has substantially parallel upper and lower flat surfaces, the flat lower surface of the token resting on the flat lower surface of the recess to cause the upper surface of the token to be flush with the upper board surface that surrounds the recess.

6. In combination:

a. a game board having a plurality of circular recesses in an upper board surface that have substantially the same depth and the same peripheral size and shape, said recesses being aligned in rows and columns and being uniformly spaced to provide parallel lines of recesses along diagonal directions, said recesses further having a substantially uniform depth between a flat lower surface in the recess and the upper board surface;

b. a first group of tokens that are adapted for use by a first player, a second group of tokens that are distinguishable from said first group and adapted for use by a second player, all of said tokens in both groups being shaped to fit into the upper board recesses, said tokens each having substantially parallel upper and lower surfaces with the lower surface of the token resting on the flat lower surface of the recess to cause the upper surface of the periphery of the token to be flush with the upper board surface that surrounds the recess; and c. the size of the token lower surface being sufficiently smaller than the size of the token upper surface to allow quick removal and lifting of the token from its respective recess by tilting of the token in response to a downwardly directed force by a finger of a player but being sufficiently large to provide a flat surface for the token to rest on when dropped into a recess by a player so that the periphery of the upper token surface is flush with the game board surface.

7. The combination as defined in claim 6 wherein the token is made of a rigid material and exterior surfaces of the token are slippery to the grasp;

a. the token has a sidewall extending between the upper and lower surfaces;

b. said sidewall having a conically shaped portion which tapers upwardly and away from the peripheral edge of the lower surface at an angle such that the token will remain level when the token lower surface is positioned on the lower surface of the recess and yet allow for easy tilting of the token by a downward force directed from the center toward a peripheral edge of the token.

8. The combination as defined in claim 7 wherein the differences between the diameters of the recess and the token are such as to prevent a long fingernail from entering the space between the peripheral edge of the token and a facing inner surface of the recess when the token is resting in the recess.

9. The combination as defined in claim 6 further including a timer for producing an audible signal at the end of a preselected time interval which is commenced by movement of a hand as said hand proceeds toward a particular token.

10. The combination as defined in claim 9 further having a switching element equally accessible to each player at the beginning of a player move and connected to said timer for initiating said time interval for comparison of the time when the audible signal occurs with the time when play resulting from movement of said particular token is completed thereby to measure the dexterity of the player.

11. The combination as defined in claim 10 wherein the two groups of tokens have different colors, and at least one token in each group has a unique appearance to be used as a penalty token.

12. The combination as defined in claim 6 wherein the differences between the diameters of the recess and the token are such as to prevent a long fingernail from entering the space between the peripheral edge of the token and a facing inner surface of the recess when the token is resting in the recess.

13. The combination as defined in claim 6 wherein the diameter of the upper surface of the token is approximately twice the diameter of the lower surface of the token and about four times the thickness of the token.

14. The combination as defined in claim 13 wherein the diameter of the upper surface of the token is approximately 28 mm and the diameter of the surrounding recess is sufficiently larger to provide for easy tipping of the token.

* * * * *